United States Patent [19]

Hara et al.

[11] Patent Number: 4,867,064

[45] Date of Patent: Sep. 19, 1989

[54] APPARATUS FOR CLEANING A PRINTING CYLINDER

[75] Inventors: Akira Hara; Minoru Ochiai, both of Tokyo, Japan

[73] Assignee: Baldwin-Japan Limited, Tokyo, Japan

[21] Appl. No.: 184,891

[22] Filed: Apr. 22, 1988

[30] Foreign Application Priority Data

May 19, 1987 [JP] Japan ..... 62-121592

[51] Int. Cl.[4] ..... B41F 35/00; B41L 41/00

[52] U.S. Cl. ..... 101/425; 101/226

[58] Field of Search ..... 101/423, 425, 228, 224, 101/226, 227; 226/11; 250/562, 563; 83/60, 597, 856

[56] References Cited

U.S. PATENT DOCUMENTS

| | | | |
|---|---|---|---|
| 2,525,982 | 10/1950 | Wescott | 101/425 |
| 2,685,626 | 8/1954 | Zwack | 226/11 X |
| 3,404,627 | 10/1968 | Halley | 226/11 X |
| 3,539,084 | 11/1970 | Bradshaw | 226/11 |
| 4,344,361 | 8/1982 | MacPhee et al. | 101/425 |
| 4,651,644 | 3/1987 | Kaempfe et al. | 101/425 |
| 4,781,116 | 11/1988 | Harada | 101/425 |

FOREIGN PATENT DOCUMENTS

| | | |
|---|---|---|
| 1093271 | 4/1982 | Japan . |
| 1093272 | 4/1982 | Japan . |

*Primary Examiner*—Edgar S. Burr
*Assistant Examiner*—James Lisehora
*Attorney, Agent, or Firm*—Morgan & Finnegan

[57] ABSTRACT

A printing cylinder cleaning apparatus for cleaning, for example, a blanket surface on a blanket cylinder of an offset press has a continuous cylinder cleaning cloth stretched between a cleaning cloth supply roll and a cleaning cloth take-up roll which are rotatably mounted on side plates of the frame of a printing machine, whereby the cylinder cleaning cloth being capable of running relative to the outer peripheral surface of a cylinder of the printing machine in contact therewith. The cylinder cleaning cloth is pressed by a suitable pressing member onto the outer peripheral surface of the cylinder of the printing machine. The apparatus further has a cutter which is disposed to cross a common line which is tangent to outer peripheral surfaces of the cleaning cloth supply roll and the cylinder respectively. In case of breakage or tearing of the cloth, the portion caught and stretched by the cylinder is cut by the cutter.

7 Claims, 6 Drawing Sheets

APPARATUS FOR CLEANING A PRINTING CYLINDER

BACKGROUND OF THE INVENTION

1. Field of the Invention

The present invention relates to an apparatus for cleaning the outer peripheral surface of a printing cylinder such as a blanket cylinder of an offset printing machine, a plate cylinder of a gravure printer and so forth. More particularly, the present invention is concerned with a cylinder cleaning apparatus suitable for preventing jamming of the cylinder with a cleaning cloth which may otherwise be caused in the event of a breakage of the cleaning cloth.

2. Description of the Prior Art

A typical known printing cylinder cleaning apparatus will be described hereinunder. Although the following description is concentrated specifically on a blanket cylinder of an offset printing machine, it is to be understood that the same printing cylinder cleaning apparatus can be used for cleaning other types of cylinders such as, for example, a plate cylinder of a gravure printer.

An offset printing machine usually has three cylinders, namely, a plate cylinder, a blanket cylinder and an impression cylinder. These cylinders are arranged such that their axes extend in parallel with one another and such that they can be brought into mutual contact. A printing plate made of, for example, zinc or aluminum is wound on the plate cylinder, while a sheet-like blanket such as of rubber is wound on the blanket cylinder. The printing plate has a grained surface and is provided with a water repellent layer carrying an image of characters or a picture. The surface of the printing plate other than portions having images of characters or picture is dampened as water is supplied to the surface of the printing plate by means of dampening device. An oily ink is applied to the surface of the printing plate by means of an inking device. The ink will attach to the portion of the plate surface carrying the image because this area is not dampened, but will be repelled by other portions of the plate surface due to the water content held by the grained surface. The ink thus held on the plate cylinder is transferred to the blanket cylinder and is further transferred to a printing paper which passes through the nip between the blanket cylinder and the impression cylinder.

After several hours of printing operation, the blanket surface is contaminated due to accumulation of residual ink. It is therefore necessary that the surface of the blanket is cleaned periodically at a predetermined period. The cleaning operation heretofore has been conducted manually, requiring labor and time.

In order to obviate this problem, an apparatus has been developed which is capable of cleaning the blanket cylinder.

This apparatus has a cleaning cloth supply roll and a cleaning cloth take-up roll arranged in a pair on a pair of side plates which are mounted on the frame of the printing mahine. A continuous cleaning cloth is wound at its both ends on these rolls and are suitable tensed between these rolls. The cleaning cloth take-up roll is driven by a driving device to rotate at a predetermined speed. A stay having a substantially T-shaped cross-section is provided to extend in the direction of axes of these rolls. Both ends of the stay are fixed to the adjacent side plates. The portion of the stay opposing to the blanket cylinder is made hollow, and the surface facing the blanket cylinder is hermetically lined with a pressure pad made of an elastic member. A plenum chamber which is defined by the end of the stay and the pressure pad is communicated with an external air compressor. As the air compressor operates, compressed air is supplied to the plenum chamber so that the pressure pad is expanded, whereby the cleaning cloth sliding on the outer surface of the pressure pad is pressed against the blanket cylinder so as to wipe off contaminants on the blanket wound on the blanket cylinder thereby cleaning the blanket surface.

Usually, the cleaning is conducted while the blanket cylinder is rotated continuously. Therefore, this known printing cylinder cleaning apparatus suffers from the following drawback. Namely, there is a risk for the cleaning cloth to be broken or torn for various reasons. There also is a fear that the cleaning cloth sticks onto the surface of the blanket cylinder due to tackiness of the ink. In such cases, the cleaning cloth is inconveniently caught by the rotating blanket cylinder to reach the plate cylinder and the impression cylinder resulting in a serious accident in the printing machine.

A known system for overcoming this problem employs a rotary encoder fixed to the shaft of the cleaning cloth supply roll so as to output the number of revolutions of the roll shaft thereby enabling to detect a tearing of the cleaning cloth through the detection of a change of revolutions of the cleaning cloth supply roll.

This system, however, is still disadvantageous in that there is a certain time lag or delay for the printing machine to be actually stopped after receipt of the signal indicative of occurrence of the tearing of the cleaning cloth. In consequence, the torn cleaning cloth is caught by the blanket cylinder to cause a serious accident. In addition, the construction of the printing machine is impractically complicated due to provision of various equipments such as the rotary encoder.

SUMMARY OF THE INVENTION

Accordingly, an object of the present invention is to provide a printing cylinder cleaning apparatus which has a simple construction but yet is capable of preventing the jamming of printing machine with the cleaning cloth so as to avoid any serious accident which may otherwise be caused by the jamming.

To this end, according to the present invention, there is provided a printing cylinder cleaning apparatus comprising: a continuous cylinder cleaning cloth stretched between a cleaning cloth supply roll and a cleaning cloth take-up roll which are rotatably mounted on side plates of the frame of a printing machine, the cylinder cleaning cloth being capable of running relative to the outer peripheral surface of a cylinder of the printing machine in contact therewith; pressing means capable of pressing the cylinder cleaning cloth onto the outer peripheral surface of the cylinder of the printing machine; and cutting means having a cutter blade which is disposed to cross a common line which is tangent to outer peripheral surfaces of the cleaning cloth supply roll and the cylinder respectively.

In operation, in the event of a jamming of the cylinder nips by the cleaning cloth, the cleaning cloth is pulled by the cylinder of the printing machine so as to be stretched along a common line which is tangent to outer peripheral surfaces of the cleaning cloth supply roll and the cylinder, so as to be contacted by the edge of the cutter blade. In consequence, the stretched portion of the cleaning cloth is cut to ensure that only a small length of the cleaning cloth is trapped and introduced into the cylinder nips, thus avoiding any serious accident.

The above and other objects, features and advantages of the present invention will become clear from the following description of the preferred embodiment when the same is read in conjunction with the accompanying drawings.

DESCRIPTION OF THE PREFERRED EMBODIMENTS

A first embodiment of the printing cylinder cleaning apparatus of the invention, suitable for cleaning the blanket cylinder of an offset printing machine, will be described hereinunder with reference to the drawings.

Figure 9:
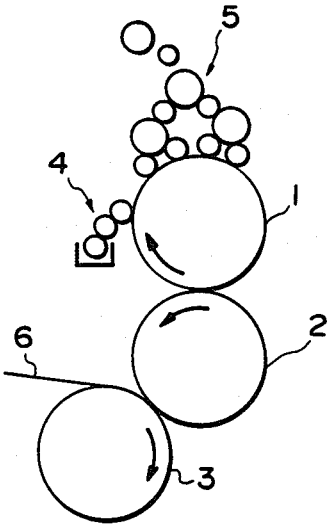
FIG. 9 is a side elevational view of an offset printing machine.

As will be seen from FIG. 9, the offset printing machine has three cylinders, namely, a plate cylinder 1, a blanket cylinder 2 and an impression cylinder 3. These cylinders are arranged such that their axes extend in parallel with one another and such that they can be brought into mutual contact. A printing plate (not shown) made of, for example, zinc or aluminum is wound on the plate cylinder 1, while a sheet-like blanket (not shown) such as of rubber is wound on the blanket cylinder 2. As well known to those skilled in the art, the surface of the printing plate is dampened as water is supplied thereto by means of a dampening device 4. An oily ink is applied to the surface of the printing plate by means of an inking device 5. The ink will attach only to the portion of the plate surface carrying an image. The ink thus held on the plate cylinder is transferred to the blanket cylinder and is further transferred to a printing paper which passes through the nip between the blanket cylinder 2 and the impression cylinder 3.

Figure 10:
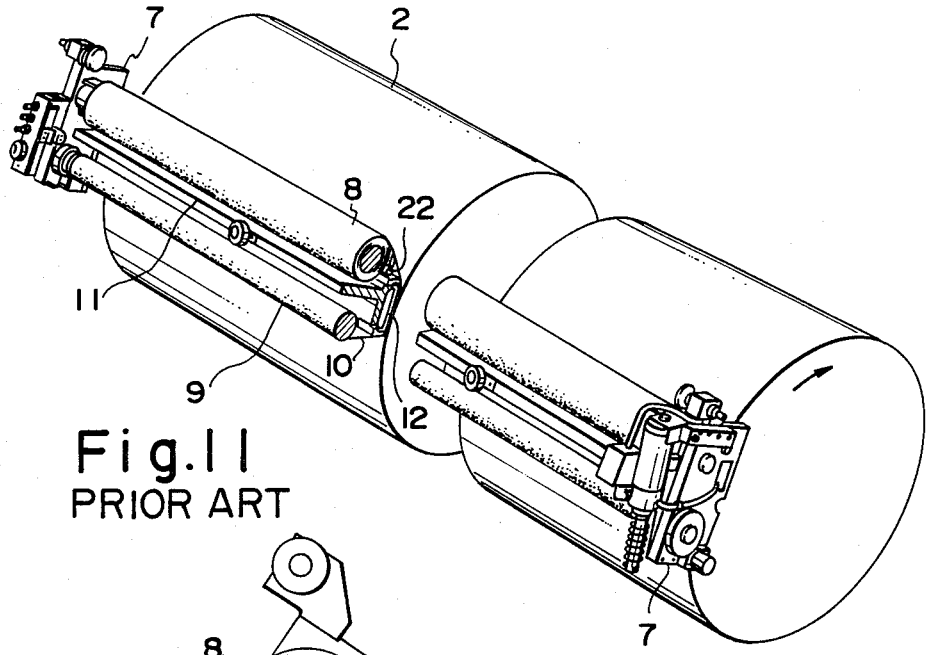
Fig. 10 PRIOR ART
FIG. 10 is a perspective view of a known blanket cylinder cleaning apparatus.
Figure 11:
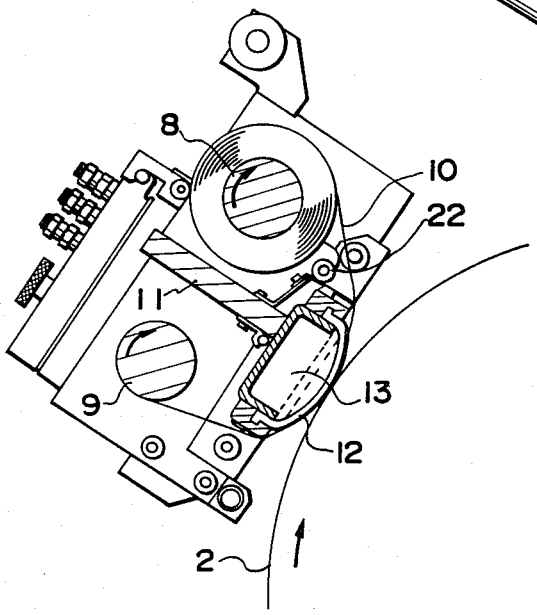
Fig. 11 PRIOR ART
FIG. 11 is a sectional view of the offset printing apparatus of FIG. 9.

The known printing cylinder cleaning apparatus shown in FIGS. 10 and 11 has a cleaning cloth supply roll 8 and a cleaning cloth take-up roll 9 arranged in a pair on a pair of side plates 7 which are mounted on the frame of the printing machine. These rolls 8 and 9 are disposed in parallel with each other and are mounted rotatably. A continuous cleaning cloth 10 is wound at its both ends on these rolls 8 and 9 and are suitably tensed between these rolls 8 and 9. The cleaning cloth take-up roll 9 is driven by a driving device (not shown) to rotate at a predetermined speed. A stay 11 having a substantially T-shaped cross-section is provided to extend in the direction of axes of these rolls 8 and 9. Both ends of the stay 11 are fixed to the adjacent side plates 7. The portion of the stay 11 opposing to the blanket cylinder 2 is made hollow, and the surface facing the blanket cylinder is hermetically lined with a pressure pad 12 made of an elastic member. A plenum chamber 13 which is defined by the end of the stay and the pressure pad 12 is communicated with an external air compressor (not shown). As the air compressor operates, compressed air is supplied to the plenum chamber so that the pressure pad 12 is expanded, whereby the cleaning cloth 10 sliding on the outer surface of the pressure pad 12 is pressed against the blanket cylinder 2 so as to wipe off contaminants on the blanket wound on the blanket cylinder thereby cleaning the blanket surface.

Figure 1:
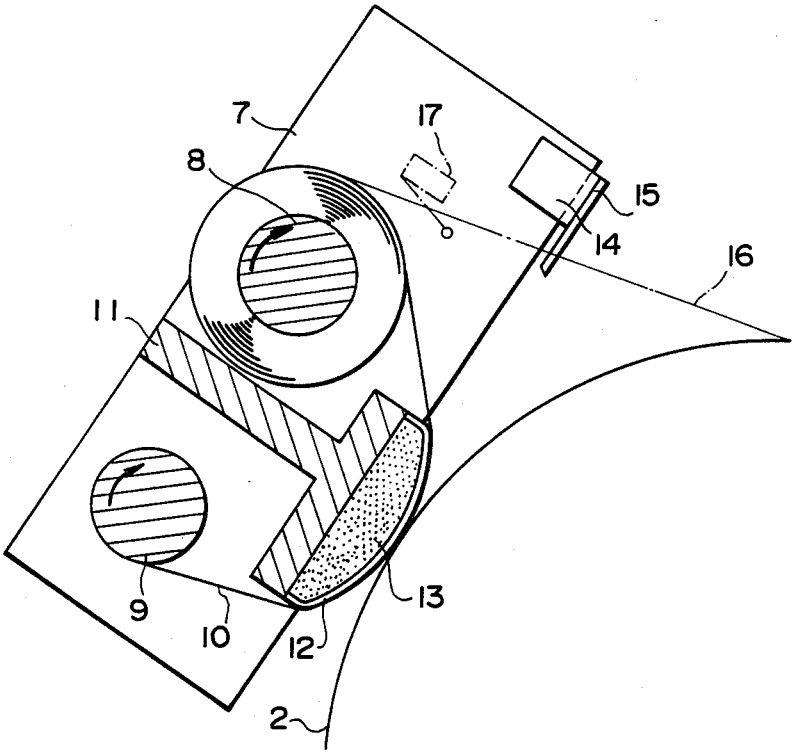
FIG. 1 is a sectional view of an essential portion of an apparatus for cleaning the blanket cylinder of an offset printing machine, as an embodiment of the printing cylinder cleaning apparatus of the present invention.
Figure 2:
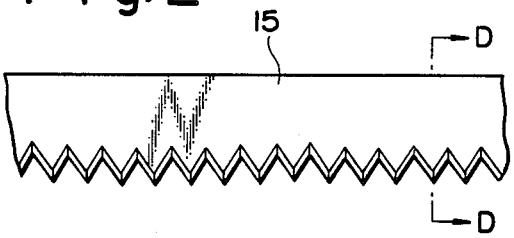
FIG. 2 is a front elevational view of a cutter blade used in the embodiment shown in FIG. 1.
Figure 3:
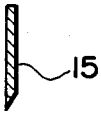
FIG. 3 is a sectional view taken along the line D—D of FIG. 2.

A first embodiment of the present invention will be described hereinunder with reference to FIGS. 1 and 2. In FIG. 1, the same reference numerals are used to denote the same parts or members as those used in FIGS. 9 to 11. The embodiment features a cutter 14 provided on the side plates 7. More specifically, the cutter 14 is provided on the portions of the side plates 7 near the cleaning cloth supply roll 8. The cutter 14 is provided on the portion thereof near the adjacent to the cleaning cloth supply roll 8 with a cutter blade 15 which extends to cross a line 16 being tangent to the outer peripheral surfaces of the cleaning cloth supply roll 8 and the blanket cylinder 2. As will be seen from FIGS. 2 and 3, the cutting blade 15 is provided with a cutting edge in the form of a single edged saw teeth.

Figure 4A:
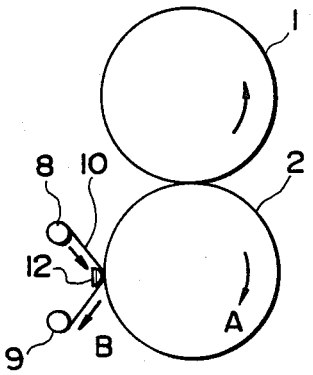
FIGS. 4A, 4B, 4C, 4D, 4E and 4F are side elevational views of the embodiment shown in FIG. 1 illustrating the operation thereof.
Figure 4B:
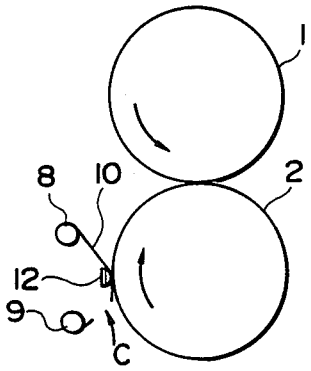
Figure 4C:
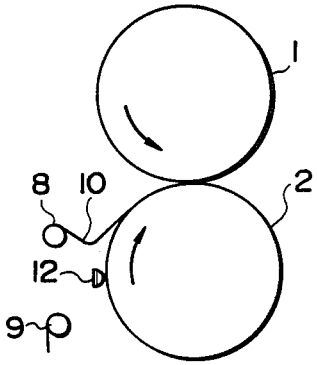

The operation of the first embodiment will be explained with reference to FIGS. 1 and 4. When the printing machine is not working or when the same is operating normally, no substantial pressure is maintained in the plenum chamber 13 so that the pressure pad 12 is deflated to keep the cylinder cleaning cloth 10 away from the blanket cylinder 2. When it is desired to clean the blanket, the compressor operates to supply compressed air into the plenum chamber 13 so that the pressure pad 12 is inflated or expanded to bring the cylinder cleaning cloth 10 into contact with the surface of the blanket wound on the blanket cylinder 2, as shown in FIG. 4A. The blanket cylinder 2 is rotated in the direction of an arrow A, while the take-up roll 9 is rotatingly driven so as to cause the cleaning cloth 10 to run in the direction of the arrow B. Meanwhile, a cleaning liquid is supplied from a spray bar 22 onto the cleaning cloth 10 so as to clean the blanket.

Figure 4D:
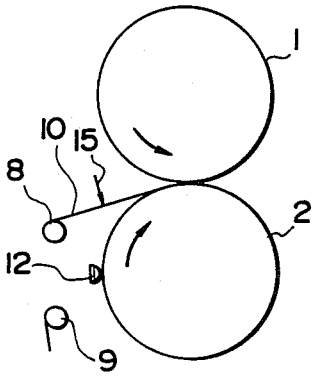
Figure 4E:
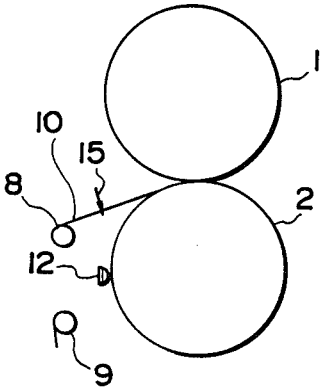
Figure 4F:
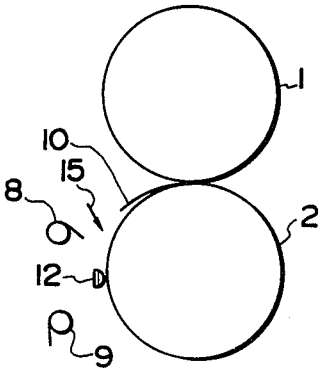

In the event that the cylinder cleaning cloth 10 is broken or torn at a point C as shown in FIG, 4B, the leading end of the trailing portion of the cylinder cleaning cloth 10 clings on the surface of the blanket and moves following up the surface of the rotating blanket cylinder 2 so as to be trapped by the nip between the plate cylinder 1 and the blanket cylinder 2, as shown in FIG. 4D. In consequence, the trapped end of the cylinder cleaning cloth is pulled by the cylinder nip so that the cylinder cleaning cloth is stretched as shown in FIG. 4E so as to be contracted and cut by the cutting edge of the cutter blade 15 because the tension in the cylinder cleaning cloth 10 acts to press the latter onto the cutting edge of the cutter blade 15. The trapping of the cylinder cleaning cloth by the cylinder nip is caused not only by the tearing of the cylinder cleaning cloth 10 but also by other reasons, e.g., sticking of the cylinder cleaning cloth 10 onto the blanket due to the tackiness of the ink. It will be readily understood that the cutting edge of the cutting blade 15 effectively cuts the cylinder cleaning cloth also in this case.

Thus, in the illustrated embodiment, only a small length of the cylinder cleaning cloth 10 is introduced into the cylinder nip because the portion of the cylinder cleaning cloth 10 stretched between the cleaning cloth supply roll 8 and the blanket cylinder 2 due to, for example, tearing of the cylinder cleaning cloth 10 which is easily and securely cut by the cutting edge of the cutter blade 15. It is therefore possible to avoid any serious accident which may otherwise be caused by jamming with a considerable length of the cylinder cleaning cloth 10.

In the illustrated embodiment of the invention, the leading end portion of the torn cylinder cleaning cloth 10 is cut by the cutter blade 15. In a modification of this embodiment, a limit switch 17 is provided as shown by broken line in FIG. 1 so as to intersect the aforementioned common tangent line so as to be turned on by the tensed cylinder cleaning cloth 10 stretched between the cleaning cloth supply roll 8 and the blanket cylinder 2, thereby producing an emergency stop signal for stopping the printing machine. Such an arrangement effectively prevents the severed portion of the cylinder cleaning cloth 10 from coming into the cylinder nip.

Figure 5:
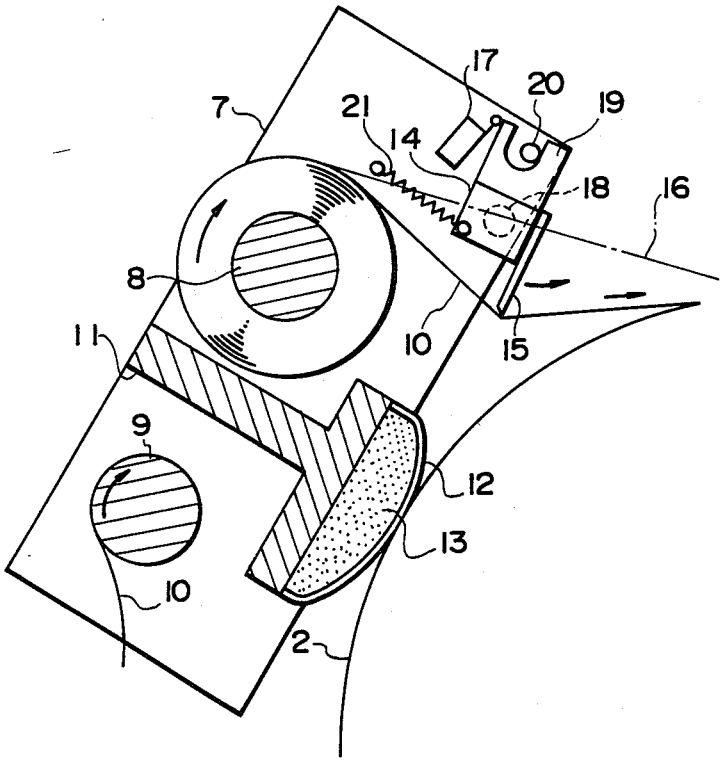
FIG. 5 is a sectional view of an essential portion of a second embodiment of the present invention.

FIG. 5 shows a second embodiment of the present invention. In this embodiment, a cutter 14 which is similar to that used in the first embodiment is mounted on the portions of the side plates 7 near the cleaning cloth supply roll 8 for a pivotal motion about a pivot shaft 18. The end of the cutter 14 opposite to the cutter blade 15 constitutes a forked lever 19 which loosely engages with a stopper pin 20 provided on the side plates 7 so as to limit the angle through which the cutter 14 pivots. A limit switch 17 provided on the side plates 7 is located such that it is turned off when the cutter 14 has pivoted to its stroke end in the clockwise direction and turned on when the same has pivoted to its stroke end in the counterclockwise direction. The cutter 14 is urged for clockwise pivot motion about the pivot shaft 18. Other portions of this embodiment are materially the same as those of the first embodiment.

The operation of the illustrated second embodiment of the present invention is as follows. As explained in connection with the first embodiment, when the cylinder cleaning cloth 10 is broken or torn, the leading end of the cylinder cleaning cloth 10 extracted from the cleaning cloth supply roll 8 is caught by, for example, the blanket cylinder 2 so that the stretched portion of the cylinder cleaning cloth 10 is pressed onto the cutter 14 so as to cause the latter to pivot about the pivot shaft 18 counterclockwise as viewed in the drawings. In consequence, the limit switch 17 is turned on to produce an emergency stop signal via a controller (not shown) so as to stop the operation of the printing machine. At the same time, the stretched portion of the cylinder cleaning cloth is cut by the cutter blade 15.

In this embodiment, when the cylinder cleaning cloth 10 is torn and caught into the nip between the blanket cylinder 2 and the plate cylinder 1, the leading end of the trailing portion of the cylinder cleaning cloth 10 causes the cutter 14 to pivot about the pivot shaft 18 which in turn causes the limit switch 17 to be turned on, whereby the plate cylinder 1 and the blanket cylinder 2 are made to stop at once, and whereby jamming of the severed portion of the cylinder cleaning cloth 10 into the cylinder nip is prevented. Even if the cylinder cleaning cloth 10 is made to jam in the cylinder nip due to a delay of response for stopping the printing machine, the amount of the jamming cloth 10 is so small because it is cut by the cutter blade 15 that the influence thereof is negligible.

Figure 6:
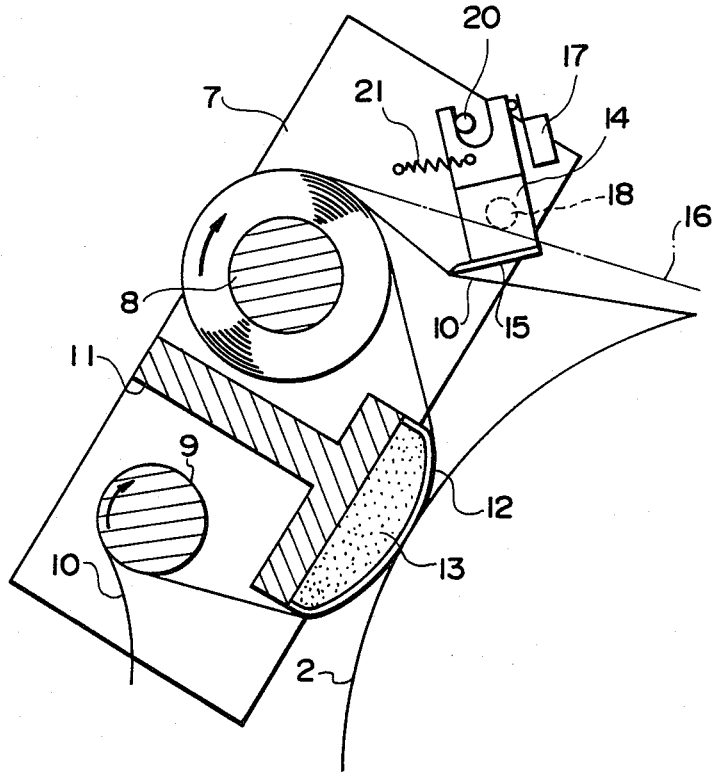
FIG. 6 is a sectional view of an essential portion of a third embodiment of the present invention.

FIG. 6 shows a third embodiment of the present invention. In this embodiment, the cutter 14, which is basically the same as that used in the second embodiment, is urged for counterclockwise rotation about the pivot shaft 18 as viewed in the figure by means of a spring 21. The limit switch 17 is however provided on the opposite side to the spring 21 with a difference from the second embodiment. Other portions are materially the same as those of the second embodiment.

The operation of the third embodiment is as follows. When the cylinder cleaning cloth 10 is torn, the trailing portion of the cylinder cleaning cloth 10 is caught by the blanket cylinder 2 so as to be stretched by the latter. As a result, the cutter 14 is made to rotate clockwise by the force which is produced by the tension in the stretched portion of the cylinder cleaning cloth. Consequently, the limit switch 17 is turned on, followed by the same operation as that described before.

Figure 7:
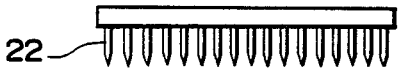
FIGS. 7 and 8 are front elevational views of other examples of the cutting blade.
Figure 8:
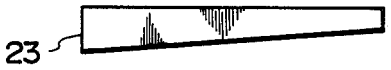

In the embodiments described hereinbefore, the cutter blade 15 is made of a single edged saw-teeth. This is however only illustrative and the cutter blade 15 may have a plurality of pins 22 arranged in a row at a predetermined pitch as illustrated in FIG. 7 in place of the saw-teeth cutting edge. The cutting edge of the cutter blade also may be slanted linear edge 23 as shown in FIG. 8. The detecting means for detecting the breakage or tearing of the cylinder cleaning cloth or the position of the cutter 14 is not limited to the limit switch 17. For instance, such a detecting means may be constituted by an optical means. It is also to be understood that, though the cylinder cleaning cloth 10 is wound uni-directionally in the described embodiment, this is not exclusive and the cloth may be a looped endless cloth.

As has been described, the present invention provides a printing cylinder cleaning apparatus having a cutter capable of cutting, in case of breakage or tearing of the cylinder cleaning cloth, the leading end portion of the trailing part of the cylinder cleaning cloth supplied from the cleaning cloth supply roll. It is therefore possible to avoid any serious accident which may be caused by jamming of the printing machine with considerable length of the cylinder cleaning cloth.

What is claimed is:

1. A printing cylinder cleaning apparatus comprising:

a continuous cylinder cleaning cloth stretched between a cleaning cloth supply roll and a cleaning cloth take-up roll which are rotatably mounted on side plates attached to the frame of a printing machine, said cylinder cleaning cloth being capable of running relative to an outer peripheral surface of a cylinder of said printing machine in contact therewith;

pressing means capable of pressing said cylinder cleaning cloth onto the outer peripheral surface of said cylinder of said printing machine; and cutting means having a cutter blade which is disposed to cross a common line which is tangent to both the outer peripheral surface of said cleaning cloth supply roll and said cylinder so as to cut a portion of said cleaning cloth stretched by a nip between said cylinder and another cylinder associated with said cylinder.

2. A printing cylinder cleaning apparatus according to claim 1, wherein said cutter blade is pivotally mounted on said side plates, further comprising detecting means for detecting a pivotal movement of said cutter blade.

3. A printing cylinder cleaning apparatus according to claim 1, further comprising detecting means capable of detecting the presence of any part of said cylinder cleaning cloth which extends across said common line which is tangent to outer peripheral surfaces of said cleaning cloth supply roll and said cylinder respectively.

4. A printing cylinder cleaning apparatus according to either one of claims 1 or 2, wherein said cutter blade has a cutting edge in the form of a single edged saw teeth.

5. A printing cylinder cleaning apparatus according to either one of claims 1 or 2, wherein said cutter blade has a cutting edge in the form of a plurality of pins arranged in a row at a predetermined pitch.

6. A printing cylinder cleaning apparatus according to either one of claims 1 or 2, wherein said cutter blade has a cutting edge in the form of a slanted linear edge.

7. A printing cleaning apparatus according to either one of claims 2 or 3, wherein said detecting means includes a limit switch.

* * * * *